US008779401B2

(12) United States Patent
Mizoguchi et al.

(10) Patent No.: US 8,779,401 B2
(45) Date of Patent: Jul. 15, 2014

(54) TARGET SUPPLY UNIT

(75) Inventors: Hakaru Mizoguchi, Oyama (JP); Takayuki Yabu, Hiratsuka (JP); Toshihiro Nishisaka, Hiratsuka (JP)

(73) Assignee: GIGAPHOTON Inc., Tochigi (JP)

( * ) Notice: Subject to any disclaimer, the term of this patent is extended or adjusted under 35 U.S.C. 154(b) by 0 days.

(21) Appl. No.: 13/533,464

(22) Filed: Jun. 26, 2012

(65) Prior Publication Data

US 2013/0048878 A1 Feb. 28, 2013

(30) Foreign Application Priority Data

Aug. 31, 2011 (JP) ..... 2011-189316

(51) Int. Cl.
*G21K 5/00* (2006.01)

(52) U.S. Cl.
USPC ..... 250/504 R; 250/492.1; 250/493.1

(58) Field of Classification Search
USPC ..... 250/492.1, 493.1, 504 R
See application file for complete search history.

(56) References Cited

U.S. PATENT DOCUMENTS

| | | | | |
|---|---|---|---|---|
| 2006/0192145 | A1 | 8/2006 | Adamec et al. | |
| 2008/0035865 | A1 * | 2/2008 | Komori et al. | 250/504 R |
| 2010/0140510 | A1 * | 6/2010 | Buescher et al. | 250/493.1 |
| 2010/0200776 | A1 * | 8/2010 | Yabu et al. | 250/504 R |

* cited by examiner

*Primary Examiner* — Nicole Ippolito
(74) *Attorney, Agent, or Firm* — McDermott Will & Emery LLP

(57) ABSTRACT

A target supply unit includes a nozzle unit having a through-hole to allow a target material to be outputted therethrough. A cover is provided to cover the nozzle unit, the cover having a through-hole to allow the target material to pass therethrough. A discharge device is included to pump out gas inside a space defined by the cover.

12 Claims, 7 Drawing Sheets

TARGET SUPPLY UNIT

CROSS-REFERENCE TO RELATED APPLICATION

The present application claims priority from Japanese Patent Application No. 2011-189316 filed Aug. 31, 2011.

BACKGROUND

1. Technical Field

This disclosure relates to a target supply unit.

2. Related Art

In recent years, semiconductor production processes have become capable of producing semiconductor devices with increasingly fine feature sizes, as photolithography has been making rapid progress toward finer fabrication. In the next generation of semiconductor production processes, microfabrication with feature sizes at 60 nm to 45 nm, and further, microfabrication with feature sizes of 32 nm or less will be required. In order to meet the demand for microfabrication with feature sizes of 32 nm or less, for example, an exposure apparatus is needed in which a system for generating extreme ultraviolet (EUV) light at a wavelength of approximately 13 nm is combined with a reduced projection reflective optical system.

Three kinds of systems for generating EUV light are known in general, which include a Laser Produced Plasma (LPP) type system in which plasma is generated by irradiating a target material with a laser beam, a Discharge Produced Plasma (DPP) type system in which plasma is generated by electric discharge, and a Synchrotron Radiation (SR) type system in which orbital radiation is used.

SUMMARY

A target supply unit according to one aspect of this disclosure may include: a nozzle unit having a through-hole to allow a target material to be outputted therethrough; a cover provided to cover the nozzle unit, the cover having a through-hole to allow the target material to pass therethrough; and a discharge device configured to pump out gas inside a space defined by the cover.

A target supply unit according to another aspect of this disclosure may include: a nozzle unit having a through-hole to allow a target material to be outputted therethrough; an electrode provided to face the nozzle unit; a voltage generator configured to apply a voltage between the target material and the electrode; and a discharge device configured to pump out gas in at least a space between the nozzle unit and the electrode.

A target supply unit according to yet another aspect of this disclosure may include: a nozzle unit having a through-hole to allow a target material to be outputted therethrough; a plurality of electrodes provided in a direction in which the target material travels; an electrical insulator for holding the plurality of electrodes; at least one voltage generator configured to apply a voltage between the plurality of electrodes; a cover provided to cover the nozzle unit, the plurality of electrodes, and the electrical insulator, the cover having a through-hole to allow the target material to pass therethrough; and a discharge device configured to pump out gas in a space defined by the cover.

BRIEF DESCRIPTION OF THE DRAWINGS

Hereinafter, selected embodiments of this disclosure will be described with reference to the accompanying drawings.

DETAILED DESCRIPTION

Figure 1:
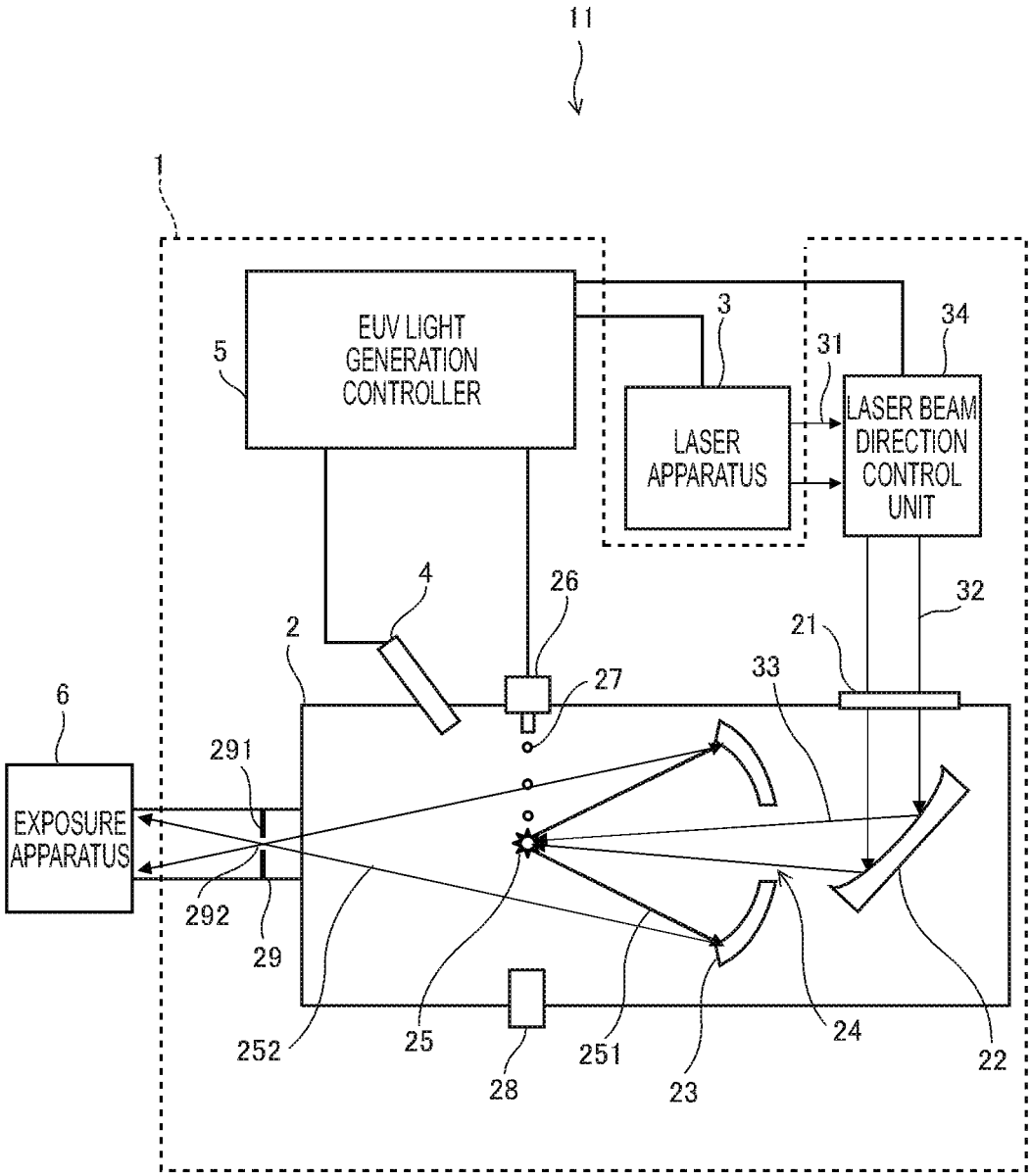
FIG. 1 schematically illustrates the configuration of an exemplary LPP type EUV light generation system.

Hereinafter, selected embodiments of this disclosure will be described in detail with reference to the accompanying drawings. The embodiments to be described below are merely illustrative in nature and do not limit the scope of this disclosure. Further, the configuration(s) and operation(s) described in each embodiment are not all essential in implementing this disclosure. Note that like elements are referenced by like reference numerals and characters, and duplicate descriptions thereof will be omitted herein.

Contents

1. Overview
2. Terms
3. Overview of EUV Light Generation System
3.1 Configuration
3.2 Operation
4. Chamber Including Electrostatic-Pull-Out Type Target Supply Unit
4.1 Configuration
4.2 Operation
5. Electrostatic-Pull-Out Type Target Supply Unit
5.1 Configuration
5.2 Operation
5.3 Effect
6. Target Supply Unit Including Acceleration Electrode
6.1 Configuration
6.2 Operation
6.3 Effect
7. Target Supply Unit Including Cover for Shielding Nozzle Unit
7.1 Configuration
7.2 Operation and Effect
8. Target Supply Unit Including Cover for Shielding Reservoir and Nozzle Unit
8.1 Configuration
8.2 Operation and Effect
9. Target Supply Unit Including Position-Adjustable Cover
9.1 Configuration
9.2 Operation and Effect 1. Overview In an LPP type EUV light generation apparatus, a target may be supplied from a target supply unit in the form of droplets toward a plasma generation region inside a chamber. The target material may be irradiated with a pulse laser beam when the target material reaches the plasma generation region. Upon being irradiated with the pulse laser beam, the target material may be turned into plasma, and EUV light may be emitted from the plasma. In order to stably supply the target material to the plasma generation region, the target material may be charged by applying a high voltage between the target material inside the target supply unit and an electrode provided so as to face a nozzle unit of the target supply unit, and the trajectory of the target material may be controlled by causing an electric field to act on the target material.

However, when a high voltage exceeding a withstand voltage is applied between the target material and the electrode, a dielectric breakdown (spark discharge) may occur. When the dielectric breakdown occurs, leakage current may flow inside the chamber, and the voltage between the target material and the electrode may become unstable. As a result, a charge given to the target material may vary, and controlling the trajectory of the charged target material may become difficult. Accordingly, charged targets may not be stably supplied to the plasma generation region.

According to one aspect of this disclosure, gas located in a space between an electrode and the nozzle unit, through which the target material is outputted, may be pumped out of the space. With the gas being pumped out, the withstand voltage across the space may be increased, whereby the dielectric breakdown may be suppressed.

2. Terms

Terms used in this application may be interpreted as follows. "Debris" may include neutral particles, of the target material supplied into the chamber, that have not been turned into plasma and ion particles emitted from the plasma, and may be a substance that causes contamination or damage to an optical element.

3. Overview of EUV Light Generation System 3.1 Configuration

FIG. 1 schematically illustrates the configuration of an exemplary LPP type EUV light generation system. An EUV light generation apparatus 1 may be used with at least one laser apparatus 3. Hereinafter, a system that includes the EUV light generation apparatus 1 and the laser apparatus 3 may be referred to as an EUV light generation system 11. As illustrated in FIG. 1 and described in detail below, the EUV light generation system 11 may include a chamber 2, a target supply unit 26, and so forth. The chamber 2 may be sealed airtight. The target supply unit 26 may be mounted to the chamber 2 so as to penetrate a wall of the chamber 2. A target material to be supplied by the target supply unit 26 may include, but is not limited to, tin, terbium, gadolinium, lithium, xenon, or any combination thereof.

The chamber 2 may have at least one through-hole formed in its wall, and a pulse laser beam 32 may travel through the through-hole into the chamber 2. Alternatively, the chamber 2 may be provided with a window 21, through which the pulse laser beam 32 may travel into the chamber 2. An EUV collector mirror 23 having a spheroidal surface may, for example, be provided inside the chamber 2. The EUV collector mirror 23 may have a multi-layered reflective film formed on the spheroidal surface thereof. The reflective film may include a molybdenum layer and a silicon layer laminated alternately. The EUV collector mirror 23 may have a first focus and a second focus, and may be positioned such that the first focus lies in a plasma generation region 25 and the second focus lies in an intermediate focus (IF) region 292 defined by the specification of an external apparatus, such as an exposure apparatus 6. The EUV collector mirror 23 may have a through-hole 24 formed at the center thereof, and a pulse laser beam 33 may travel through the through-hole 24 toward the plasma generation region 25.

The EUV light generation system 11 may further include an EUV light generation controller 5 and a target sensor 4. The target sensor 4 may have an imaging function and detect at least one of the presence, the trajectory, and the position of a target 27.

Further, the EUV light generation system 11 may include a connection part 29 that allows the interior of the chamber 2 and the interior of the exposure apparatus 6 to be in communication with each other. A wall 291 having an aperture may be provided inside the connection part 29, and the wall 291 may be positioned such that the second focus of the EUV collector mirror 23 lies in the aperture formed in the wall 291.

The EUV light generation system 11 may also include a laser beam direction control unit 34, a laser beam focusing mirror 22, and a target collector 28 for collecting targets 27. The laser beam direction control unit 34 may include an optical element for defining the direction into which the pulse laser beam 32 travels and an actuator for adjusting the position and the orientation (posture) of the optical element.

3.2 Operation

With continued reference to FIG. 1, a pulse laser beam 31 outputted from the laser apparatus 3 may pass through the laser beam direction control unit 34 and be outputted therefrom as the pulse laser beam 32 after having its direction optionally adjusted. The pulse laser beam 32 may travel through the window 21 and enter the chamber 2. The pulse laser beam 32 may travel inside the chamber 2 along at least one beam path, be reflected by the laser beam focusing mirror 22, and strike at least one target 27 as a pulse laser beam 33.

The target supply unit 26 may be configured to output the target(s) 27 toward the plasma generation region 25 inside the chamber 2. The target 27 may be irradiated with at least one pulse of the pulse laser beam 33. Upon being irradiated with the pulse laser beam 33, the target 27 may be turned into plasma, and rays of light including EUV light 251 may be emitted from the plasma. The EUV light 251 may be reflected selectively by the EUV collector mirror 23. EUV light 252 reflected by the EUV collector mirror 23 may travel through the intermediate focus region 292 and be outputted to the exposure apparatus 6. The target 27 may be irradiated with multiple pulses included in the pulse laser beam 33.

The EUV light generation controller 5 may be configured to integrally control the EUV light generation system 11. The EUV light generation controller 5 may be configured to process image data of the target 27 captured by the target sensor 4. Further, the EUV light generation controller 5 may be configured to control at least one of the timing at which the target 27 is outputted and the direction into which the target 27 is outputted. Furthermore, the EUV light generation controller 5 may be configured to control at least one of the timing at which the laser apparatus 3 oscillates, the direction in which the pulse laser beam 32 travels, and the position at which the pulse laser beam 33 is focused. It will be appreciated that the various controls mentioned above are merely examples, and other controls may be added as necessary.

Figure 2:
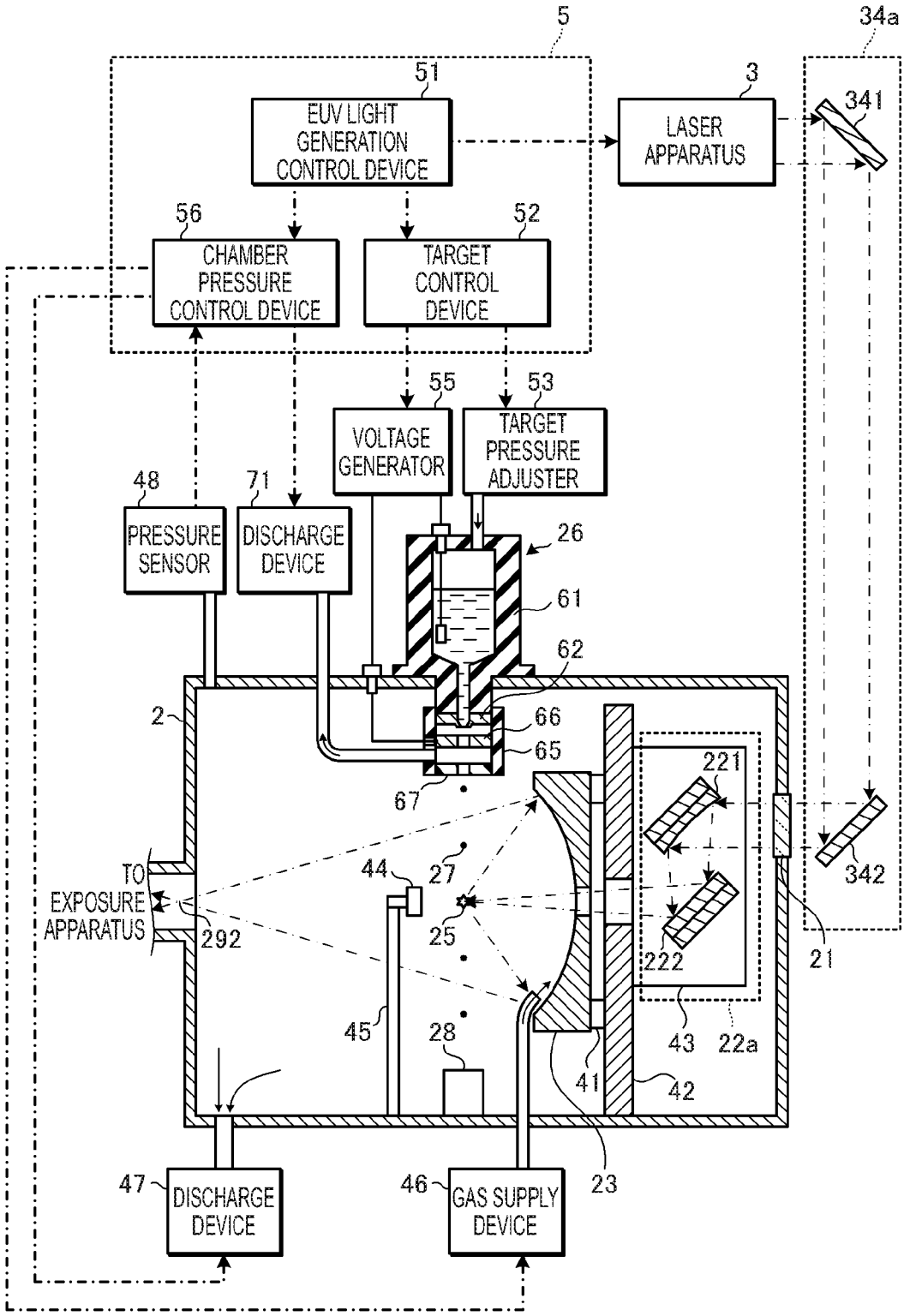
FIG. 2 is a partial sectional view schematically illustrating the configuration of an EUV light generation apparatus according to a first embodiment.

4. Chamber Including Electrostatic-Pull-Out Type Target Supply Unit 4.1 Configuration FIG. 2 is a partial sectional view illustrating the configuration of an EUV light generation apparatus according to a first embodiment. As shown in FIG. 2, a laser beam focusing optical system 22*a*, the EUV collector mirror 23, the target collection unit 28, and a beam dump 44 may be provided inside the chamber 2.

The chamber 2 may include a member, such as an electrically conductive member, formed of an electrically conductive material, for example, a metal material. The chamber 2 may further include an electrically non-conductive member. In that case, the wall of the chamber 2 may be constituted by the electrically conductive member, and the electrically non-conductive member(s) may be provided inside the chamber 2. A plate 42 may be attached to the chamber 2, and a plate 43 may be attached to the plate 42. The EUV collector mirror 23 may be attached to the plate 42 through an EUV collector mirror mount 41.

The laser beam focusing optical system 22*a* may include an off-axis paraboloidal mirror 221, a flat mirror 222, and holders for the respective mirrors 221 and 222. The off-axis paraboloidal mirror 221 and the flat mirror 222 may be mounted on the plate 43 through the respective mirror holders such that a laser beam reflected sequentially by these mirrors is focused in the plasma generation region 25. The beam dump 44 may be fixed to the chamber 2 through a beam dump support member 45 so as to be positioned on an extension of the beam path of the laser beam traveling toward the plasma generation region 25. The target collector 28 may be provided in the chamber 2 downstream from the plasma generation region 25 in the direction in which the target 27 travels.

The chamber 2 may include the window 21 (laser beam port) and the target supply unit 26. The details of the target supply unit 26 will be given later. Electrically conductive metal or the like may be used as the target material. In the embodiments disclosed in this specification, tin (Sn), whose melting point is 232° C., may, for example, be used as the target material. Further, a gas supply device 46, a discharge device 47, and a pressure sensor 48 may be connected to the chamber 2.

A beam steering unit 34*a* and the EUV light generation controller 5 may be provided outside the chamber 2. The beam steering unit 34*a* may include high-reflection mirrors 341 and 342, holders (not shown) for the respective mirrors 341 and 342, and a housing in which the mirrors 341 and 342 are disposed. The EUV light generation controller 5 may include an EUV light generation control device 51, a target control device 52, and a chamber pressure control device 56. The chamber pressure control device 56 may respectively be connected to the gas supply device 46, the discharge device 47, and the pressure sensor 48 through respective signal lines.

4.2 Operation

A buffer gas and/or an etching gas may be introduced into the chamber 2. The buffer gas may be introduced to reduce the amount of debris, which is generated when the target material is irradiated with the laser beam, being deposited on the EUV collector mirror 23. The etching gas may be introduced to etch the debris deposited on the EUV collector mirror 23. Argon (Ar), neon (Ne), helium (He), or the like may be used as the buffer gas. Hydrogen ($H_2$), hydrogen bromide (HBr), hydrogen chloride (HCl), or the like may be used as the etching gas.

The gas supply device 46 may be configured to supply a hydrogen gas so as to flow along the reflective surface of the EUV collector mirror 23. With this configuration, tin (Sn) deposited on the surface of the EUV collector mirror 23 may be etched through a reaction expressed as follows:

$$\text{Sn (solid)} + 2H_2\text{ (gas)} \rightarrow SnH_4\text{ (gas)}$$

The discharge device 47 may be configured to discharge gas, such as hydrogen ($H_2$) and tin hydride ($SnH_4$) generated as tin is etched, from the chamber 2. The chamber pressure control device 56 may be configured to control the gas supply device 46 and the discharge device 47 based on a control signal from the EUV light generation control device 51 and a detection signal from the pressure sensor 48. By controlling the gas supply device 46 and the discharge device 47, the chamber pressure control device 56 may retain the gas pressure of the buffer gas and/or the etching gas inside the chamber 2 at predetermined pressure.

The target supply unit 26 may be configured to charge the target material and supply the charged target material to the plasma generation region 25. A laser beam outputted from the laser apparatus 3 may be reflected sequentially by the high-reflection mirrors 341 and 342, and enter the laser beam focusing optical system 22*a* through the window 21. The laser beam that has entered the laser beam focusing optical system 22*a* may be reflected sequentially by the off-axis paraboloidal mirror 221 and the flat mirror 222.

The EUV light generation control device 51 may be configured to output a target output signal to the target control device 52 and a laser beam output signal to the laser apparatus 3. Through these signals, the target material outputted from the target supply unit 26 may be irradiated with the laser beam at a timing at which the target material reaches the plasma generation region 25. Upon being irradiated with the laser beam, the target material may be turned into plasma, and EUV light may be emitted from the plasma. The emitted EUV light may be reflected by the EUV collector mirror 23, focused in the intermediate focus region 292, and outputted to an exposure apparatus.

5. Electrostatic-Pull-Out Type Target Supply Unit 5.1 Configuration

Figure 3:
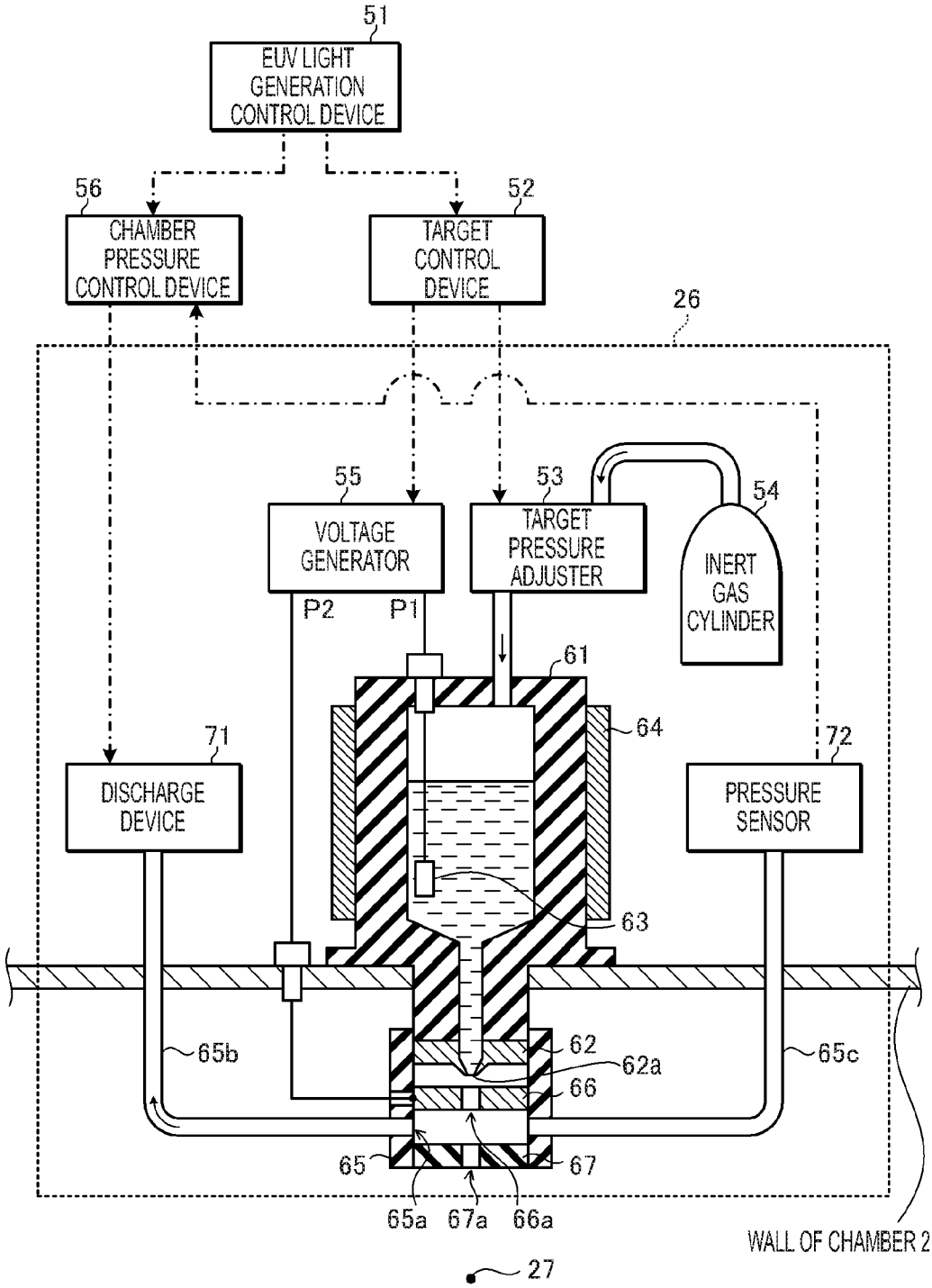
FIG. 3 is a sectional view illustrating a target supply unit shown in FIG. 2 and the peripheral components.

FIG. 3 is a sectional view illustrating the target supply unit shown in FIG. 2 and the peripheral components. As shown in FIG. 3, the target supply unit 26 may include a reservoir 61, a nozzle unit (target output unit) 62, an electrode 63, a heater 64, an electrical insulator 65, a pull-out electrode 66, an aperture member 67, a discharge device 71, and a pressure sensor 72. The reservoir 61 and the nozzle unit 62 may be formed integrally or separately.

The reservoir 61 may be formed of an electrically non-conductive material, such as synthetic quartz, alumina, or the like. The reservoir 61 may store tin serving as the target material. The heater 64 may be mounted around the reservoir 61 to heat the reservoir 61 so that tin inside the reservoir 61 is kept in a molten state. The heater 64 may be used with a temperature sensor (not shown) configured to detect the temperature of the reservoir 61, a heater power supply (not shown) configured to supply electric current to the heater 64, and a temperature controller (not shown) configured to control the heater power supply based on the temperature detected by the temperature sensor.

The target material may be outputted toward the plasma generation region 25 through the nozzle unit 62. The nozzle unit 62 may have a through-hole (orifice) 62*a* formed therein, through which the target material is outputted. The through-hole 62*a* in the nozzle unit 62 may be in communication with the interior of the reservoir 61. The nozzle unit 62 may have a tip portion projecting from an outer surface so that an electric field is enhanced at the target material in the tip portion of the nozzle unit 62. The aforementioned through-hole (orifice) 62*a* may be formed in the tip portion of the nozzle unit 62.

The cylindrical electrical insulator 65 may be attached to the nozzle unit 62. The pull-out electrode 66 may be held in the electrical insulator 65. The electrical insulator 65 may provide electrical insulation between the nozzle unit 62 and the pull-out electrode 66. The pull-out electrode 66 may be provided so as to face the outer surface of the nozzle unit 62 in order to cause an electric field to act therebetween. With this configuration, the target material may be pulled out through the orifice 62*a* in the nozzle unit 62. The pull-out electrode 66 may have a through-hole 66*a* formed therein to allow charged targets 27 to pass therethrough.

The aperture member 67 may be provided downstream from the pull-out electrode 66 in a trajectory of the target 27, and may be fixed to the electrical insulator 65. The aperture member 67 may have a through-hole 67*a* formed therein to allow the target 27 to pass therethrough.

A discharge port 65*a* may be formed in a portion of the electrical insulator 65, the portion being located between a part at which the electrical insulator 65 is connected to the nozzle unit 62 and a part at which the aperture member 67 is connected to the electrical insulator 65. The discharge port 65*a* may be connected to a discharge pipe 65*b*. The discharge pipe 65*b* may be connected to the discharge device 71 provided outside of the chamber 2. Further, the pressure sensor 72 may be connected to the electrical insulator 65 through a communication path 65*c* which is in communication with the interior of the electrical insulator 65. The pressure sensor 72 may be provided outside the chamber 2.

The target supply unit 26 may further include a target pressure adjuster 53, an inert gas cylinder 54, and a voltage generator 55. The inert gas cylinder 54 may be connected to the target pressure adjuster 53 through a pipe for supplying the inert gas. The target pressure adjuster 53 may be in communication with the interior of the reservoir 61 through another pipe for supplying the inert gas.

5.2 Operation

The reservoir 61 may be heated by the heater 64 to a temperature equal to or higher than 232° C. (melting point of tin). Being heated to the above temperature, the target material may be stored inside the reservoir 61 in a molten state.

The target control device 52 may be configured to output a target generation signal to the voltage generator 55. In accordance with the target generation signal, the voltage generator 55 may apply a pulsed voltage between the electrode 63, which is in contact with the target material inside the reservoir 61, and the pull-out electrode 66. With the pulsed voltage being applied, Coulomb force may be generated between the target material and the pull-out electrode 66. As a result, the target material may be pulled out through the through-hole 62*a* in the nozzle unit 62, and a charged target 27 may be generated.

The target pressure adjuster 53 may be configured to adjust the pressure of the inert gas supplied from the inert gas cylinder 54 as necessary, and pressurize the target material inside the reservoir 61. Being pressurized by the inert gas, the target material may project slightly from the tip portion of the nozzle unit 62. Then, the electric field may be enhanced at the target material projecting from the tip portion. As the electric field is enhanced at the target material, stronger Coulomb force may act between the target material and the pull-out electrode 66. The target control device 52 may be configured to control the target pressure adjuster 53 and the voltage generator 55 such that the target 27 is generated at a timing specified by the EUV light generation control device 51.

Wiring connected to one of the output terminals of the voltage generator 55 may be connected to the electrode 63 through an airtight terminal, or feedthrough provided in the reservoir 61. Wiring connected to the other output terminal of the voltage generator 55 may be connected to the pull-out electrode 66 through a feedthrough provided in the chamber 2 and a through-hole formed in the electrical insulator 65. The voltage generator 55 may be configured to generate a pulsed voltage to cause the Coulomb force to act between the target material and the pull-out electrode 66 under the control of the target control device 52.

For example, the voltage generator 55 may generate a voltage that varies in pulses between the reference potential (0 V) and a potential P1, which is higher than the reference potential. In this case, the reference potential may be applied to the pull-out electrode 66, and the potential P1 may be applied to the electrode 63.

Alternatively, the voltage generator 55 may be configured to generate a voltage that varies in pulses between the potential P1 and a potential P2, which is higher than the potential P1. In this case, the potential P1 may be applied to the target material through the electrode 63, and the potential P2 may be applied to the pull-out electrode 66. With this configuration, a pulsed voltage may be applied between the target material and the pull-out electrode 66.

Alternatively, when the nozzle unit 62 is formed of an electrically conductive material, such as metal, the voltage generator 55 may apply a pulsed voltage between the nozzle unit 62 and the pull-out electrode 66.

The discharge device 71 may be configured to pump out gas located in a space inside the electrical insulator 65 through the discharge port 65*a* and the discharge pipe 65*b*. Pressure in the space inside the electrical insulator 65 may be measured by the pressure sensor 72, and obtained data may be inputted to the chamber pressure control device 56. The chamber pressure control device 56 may be configured to control the operation of the discharge device 71 based on the data inputted from the pressure sensor 72.

5.3 Effect

In order to generate targets 27 with stable size, under stable timing and with stable charge amount, a voltage applied between the electrodes may be stable. However, when the buffer gas and/or the etching gas are/is present inside the chamber 2, a withstand voltage between the electrodes tends to be decreased, whereby a dielectric breakdown is more likely to occur. When the dielectric breakdown occurs, a predetermined voltage may not be applied between the electrodes, and at least one of the size, the output timing, and the charge amount of the targets 27 may become unstable. In other instances, the target 27 may not be outputted.

A spark discharge may occur when an electron accelerated through an electric field collides with a gas molecule to ionize the gas. Accordingly, when the number of gas molecules decreases, the collision becomes less likely to occur. On the other hand, when the number of gas molecules increases, the gas molecules may not be accelerated sufficiently prior to the collision. Thus, the spark discharge may become less likely to occur in either case. However, when a large number of gas molecules are present in the chamber 2, transmittance of the EUV light may decrease, whereby the efficiency of the EUV light generation apparatus may be reduced. Thus, the dielectric breakdown may preferably be suppressed by pumping out gas located inside the chamber 2.

There are cases where a buffer gas and/or an etching gas are/is supplied into the chamber 2, and the chamber 2 may not be kept under vacuum. Therefore, in the first embodiment, while the interior of the chamber 2 is kept at a predetermined gas pressure, gas in a space around the pull-out electrode 66 may be pumped out locally. As a result, the number of gas molecules in the aforementioned space may be reduced, whereby the dielectric breakdown may be suppressed.

According to the first embodiment, the dielectric breakdown may be suppressed by pumping out gas that is located in the space inside the electrical insulator 65. As a result, the voltage applied between the target material and the pull-out electrode 66 may be stabilized, whereby the targets 27 may be supplied into the chamber 2 stably.

6. Target Supply Unit Including Acceleration Electrode 6.1 Configuration

Figure 4:
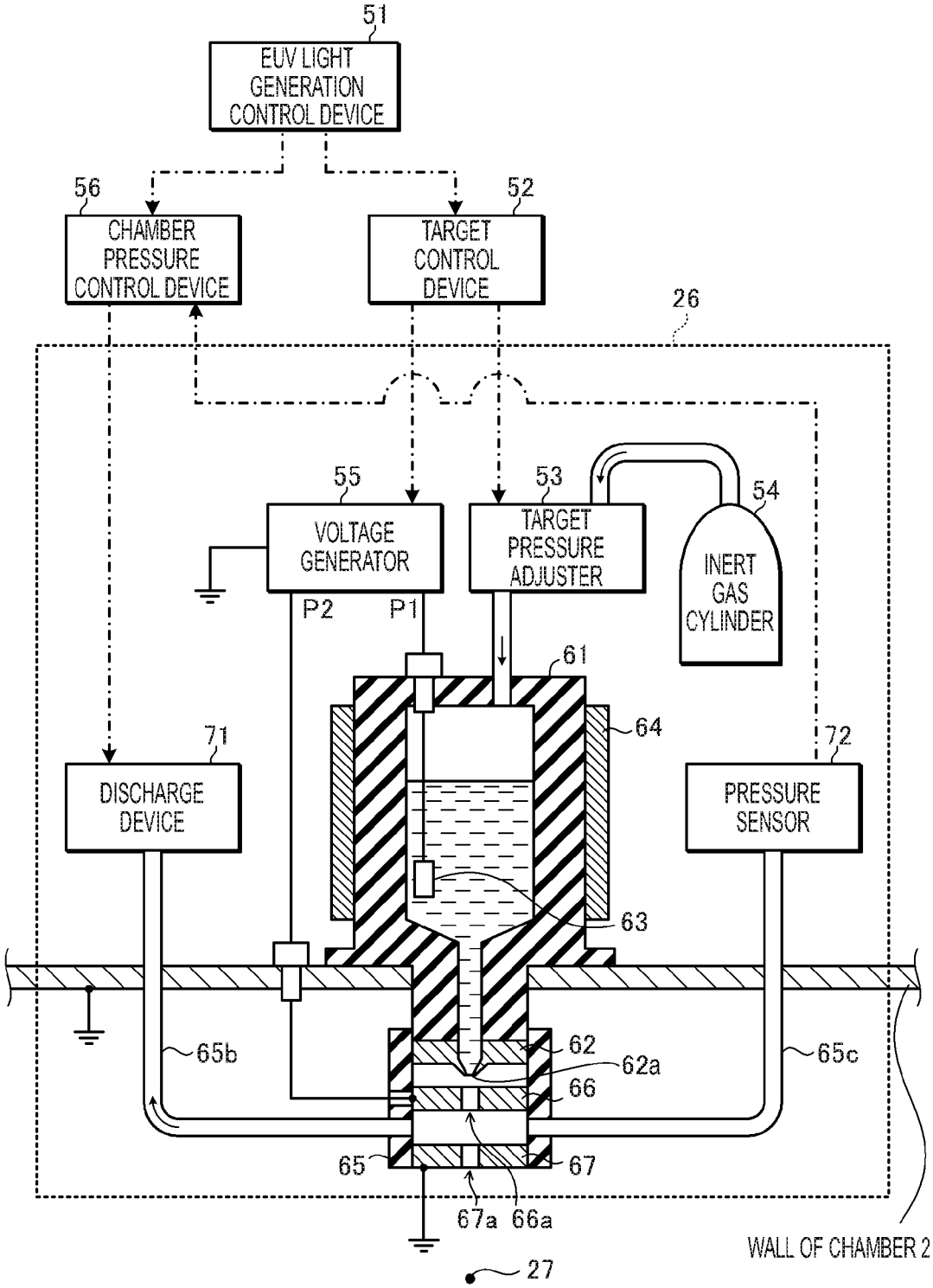
FIG. 4 is a sectional view illustrating a target supply unit according to a second embodiment and the peripheral components.

FIG. 4 is a sectional view illustrating a target supply unit according to a second embodiment and the peripheral components. In the second embodiment, a predetermined potential may be applied to the aperture member 67, whereby the aperture member 67 may serve as an acceleration electrode.

The electrically conductive member (i.e., the wall) of the chamber 2 may be connected electrically to the reference potential of the voltage generator 55, or may be grounded. The aperture member 67 may be formed of an electrically conductive material, and may be connected electrically to the reference potential. The configuration pertaining to pumping out gas located in the space inside the electrical insulator 65 may be similar to that of the first embodiment.

6.2 Operation

The voltage generator 55 may apply a predetermined potential P2, such as 10 kV, to the pull-out electrode 66. Further, the voltage generator 55 may, in the initial state, retain a potential applied to the target material at a potential P1. When the target material is to be pulled out, the voltage generator 55 may raise the potential applied to the target material from the potential P1 to another predetermined potential, for example, 20 kV. Through this operation, a positively charged target 27 may be pulled out through the nozzle unit 62.

The target 27 may be pulled out toward the pull-out electrode 66, and may pass through the through-hole 66*a* formed in the pull-out electrode 66. Thereafter, the target 27 may be accelerated toward the aperture member 67, at which the reference potential is applied.

In this way, the target 27 may be accelerated through a potential gradient formed along a path from the nozzle unit 62 to the aperture member 67 via the pull-out electrode 66, and may pass through the through-hole 67*a* in the aperture member 67. In the path of the target 27 that has passed through the through-hole 67*a*, the potential gradient may be gradual since the wall of the chamber 2 is connected to the reference potential. Accordingly, after passing through the through-hole 67*a*, the target 27 may travel inside the chamber 2 with a kinetic momentum at the time of passing through the through-hole 67*a*.

6.3 Effect

According to the second embodiment, a voltage may be present between the aperture member 67 and the pull-out electrode 66, but a dielectric breakdown may be suppressed by pumping out gas located in the space inside the electrical insulator 65. Further, with this configuration, the speed of the target 27 may be controlled with precision.

Figure 5:
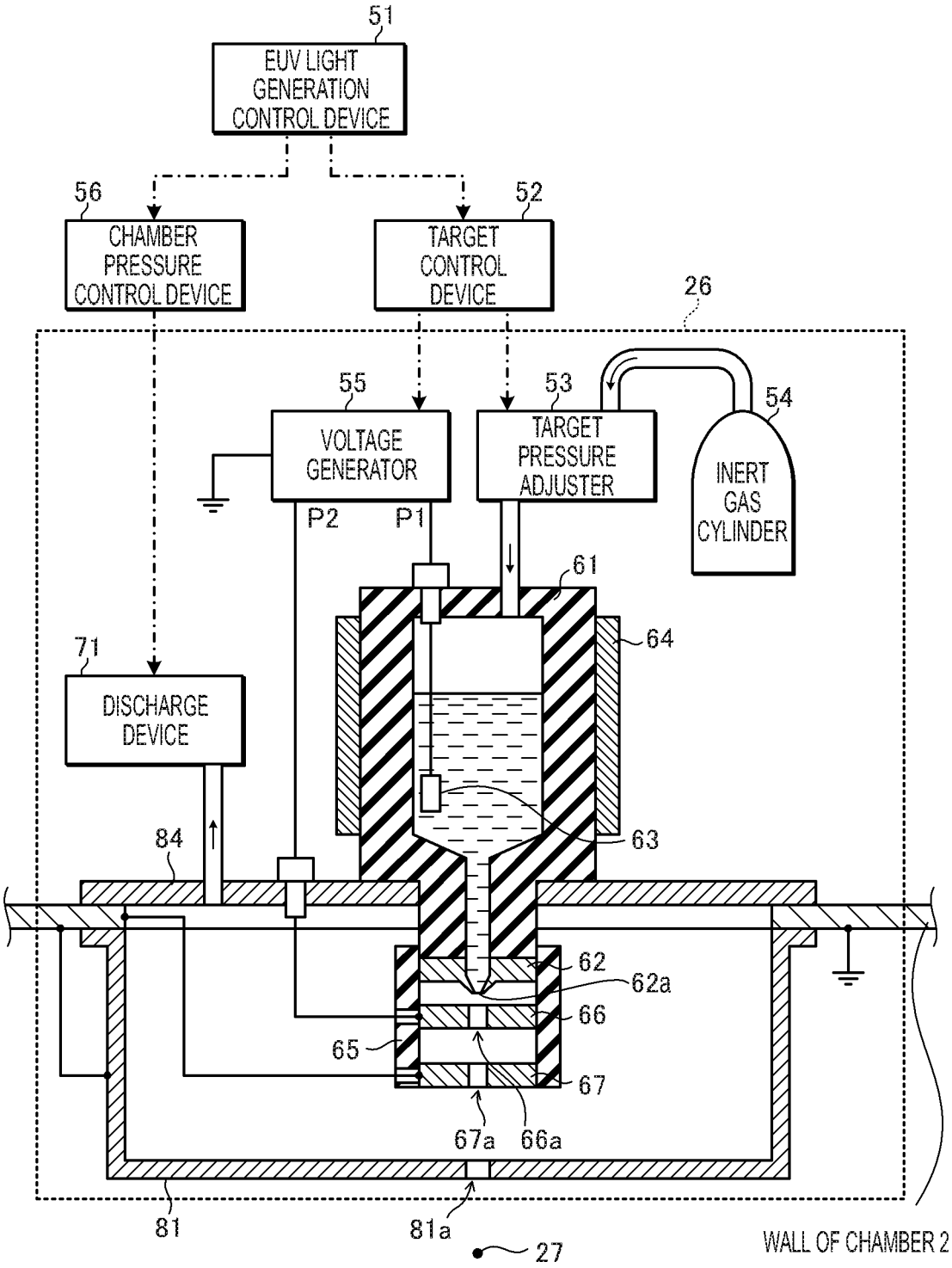
FIG. 5 is a sectional view illustrating a target supply unit according to a third embodiment and the peripheral components.

7. Target Supply Unit Including Cover for Shielding Nozzle Unit 7.1 Configuration FIG. 5 is a sectional view illustrating a target supply unit according to a third embodiment and the peripheral components. In the third embodiment, a cover 81 may be attached on the inner surface of the wall of the chamber 2. The cover 81 may be provided so as to cover the leading end portion of the target supply unit 26 including at least the electrical insulator 65. The cover 81 may have a through-hole 81*a* formed therein to allow the targets 27 to pass therethrough.

The cover 81 may be formed of an electrically conductive material, such as metal, and directly connected to the electrically conductive member (i.e., the wall) of the chamber 2. Alternatively, the cover 81 may be connected electrically to the wall of the chamber 2 through an electrically conductive connection member, such as a wire. The wall of the chamber 2 may be connected electrically to the reference potential of the voltage generator 55, or may be grounded. The cover 81 may cover a part of the reservoir 61, the nozzle unit 62, the electrical insulator 65, and the pull-out electrode 66 inside the chamber 2. Further, the cover 81 may preferably cover the aperture member 67, which may serve as an acceleration electrode, inside the chamber 2. The aperture member 67 may be connected electrically to the wall of the chamber 2 through a through-hole formed in the electrical insulator 65.

The reservoir 61 may be mounted to the chamber 2 through a flange 84. The flange 84 may be formed of an electrically non-conductive material. A space defined by the cover 81 and the wall of the chamber 2, and optionally the flange 84, may be in communication with the discharge device 71 provided outside the chamber 2.

7.2 Operation and Effect

The cover 81 may shield electrically non-conductive materials, such as the electrical insulator 65, from charged particles emitted from plasma generated in the plasma generation region 25. Gas in the space defined by the cover 81 and the wall of the chamber 2, and optionally the flange 84, may be pumped out by the discharge device 71. The gas being pumped out from the aforementioned space, occurrence of a dielectric breakdown around the pull-out electrode 66 and the aperture member 67 may be suppressed. Further, even when the reservoir 61 is formed of an electrically conductive material, occurrence of a dielectric breakdown between the reservoir 61 and the chamber 2 may be suppressed if the flange 84 is formed of an electrically non-conductive material.

Figure 6:
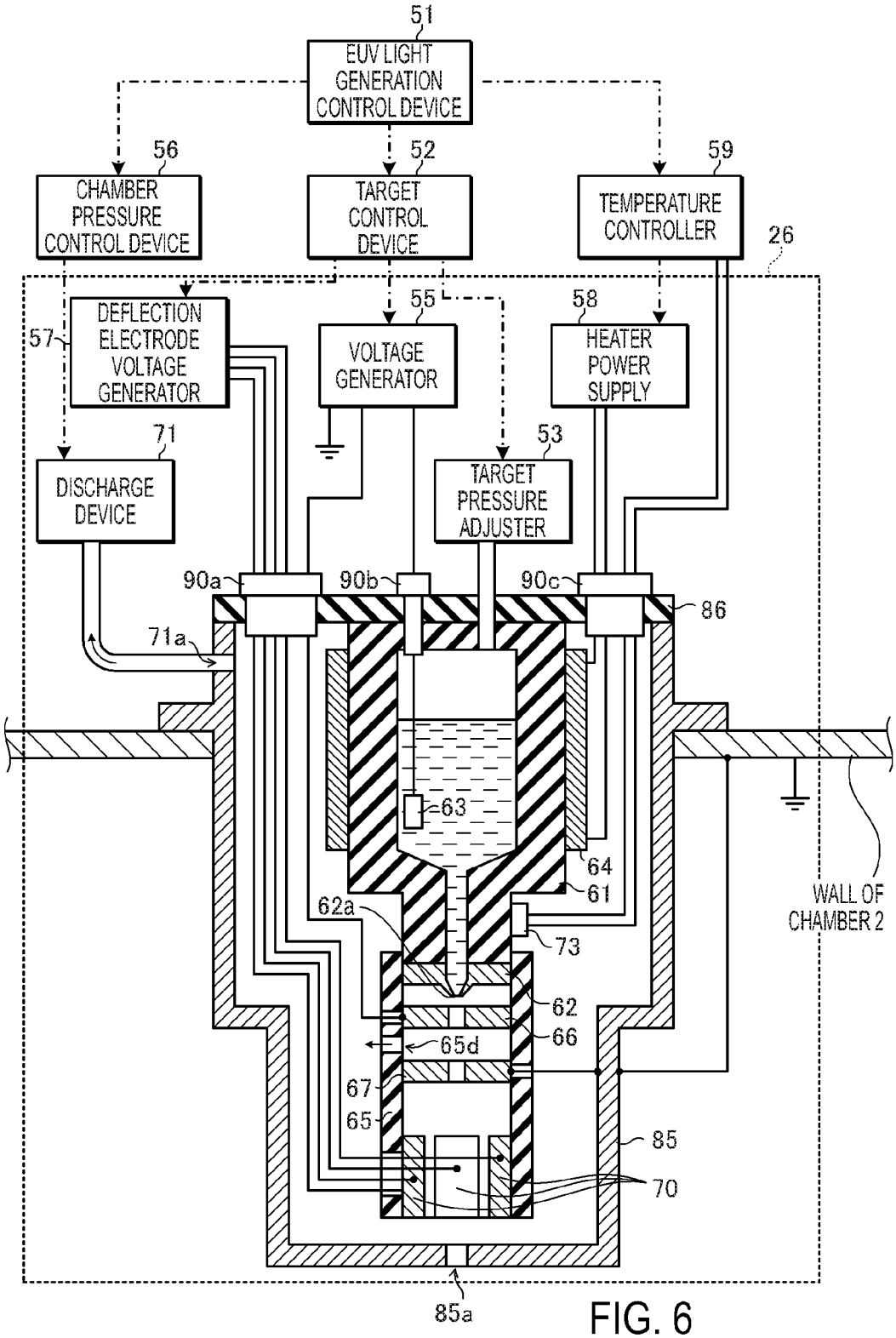
FIG. 6 is a sectional view illustrating a target supply unit according to a fourth embodiment and the peripheral components.

8. Target Supply Unit Including Cover for Shielding Reservoir and Nozzle Unit 8.1 Configuration FIG. 6 is a sectional view illustrating a target supply unit according to a fourth embodiment and the peripheral components. In the fourth embodiment, a cover 85 may cover the reservoir 61, the nozzle unit 62, the electrical insulator 65, and the pull-out electrode 66. The cover 85 may further cover the aperture member 67, deflection electrodes 70 which will be described later, and a temperature sensor 73.

As shown in FIG. 6, primary constituent elements of the target supply unit 26, such as the reservoir 61 and so forth, may be housed in a shielding container which includes the cover 85 and a lid 86 attached to the cover 85. The cover 85 may be mounted to the wall of the chamber 2. The cover 85 may have a through-hole 85*a* formed therein to allow the targets 27 to pass therethrough. The lid 86 may seal the opening in the cover 85 outside the chamber 2. The reservoir 61 may be mounted to the cover 85 through the lid 86.

The cover 85 may be formed of an electrically conductive material, such as metal, and directly connected to the wall of the chamber 2. Alternatively, the cover 85 may be connected electrically to the wall of the chamber 2 through an electrically conductive connection member, such as a wire. The wall of the chamber 2 may be connected electrically to the reference potential of the voltage generator 55, or may be grounded. An electrically non-conductive material, such as mullite, may be used as a material for the lid 86.

Multiple deflection electrodes 70 may be provided downstream from the aperture member 67 in the direction in which the target 27 travels. In the example shown in FIG. 6, two pairs of multiple deflection electrodes 70 are indicated. The deflection electrodes 70 may be held by the electrical insulator 65.

The heater 64 may be mounted on the outer surface of the reservoir 61. The heater 64 may be used with the temperature sensor 73 configured to detect the temperature of the reservoir 61. A heater power supply 58 may be configured to supply electric current to the heater 64, and a temperature controller 59 may be configured to control the heater power supply 58 based on the temperature detected by the temperature sensor 73.

Wiring of the pull-out electrode 66 and wiring of the deflection electrodes 70 may be connected to the voltage generator 55 and a deflection electrode voltage generator 57, respectively, through respective through-holes formed in the electrical insulator 65 and a relay terminal 90*a* provided in the lid 86. Wiring of the aperture member 67 may be connected electrically to the cover 85 through a through-hole formed in the electrical insulator 65, or may be connected to the voltage generator 55 through wiring (not shown) and the relay terminal 90*a*.

Wiring of the electrode 63 may be connected to the voltage generator 55 through a relay terminal 90*b* provided in the lid 86. Wiring of the heater 64 and wiring of the temperature sensor 73 may be connected to the heater power supply 58 and the temperature controller 59, respectively, through a relay terminal 90*c* provided in the lid 86.

A space inside the shielding container, which includes the cover 85 and the lid 86, and a space outside the reservoir 61, may be in communication with the discharge device 71 provided outside the chamber 2 through a connection port 71*a*. The electrical insulator 65 may have an opening 65*d* formed therein to facilitate pumping of gas in the space inside the electrical insulator 65. Although not shown in FIG. 6, an inert gas cylinder may be connected to the target pressure adjuster 53 through a pipe to supply an inert gas.

8.2 Operation and Effect

As the electric current flows in the heater 64 from the heater power supply 58, the reservoir 61 and the target material inside the reservoir 61 may be heated. The temperature controller 59 may be configured to receive a control signal from the EUV light generation control device 51 and a detection signal from the temperature sensor 73, and control the electric current to be supplied from the heater power supply 58 to the heater 64. The temperature of the reservoir 61 may be controlled to a temperature equal to or higher than the melting point of tin so that tin serving as the target material is retained in a molten state.

The target control device 52 may be configured to output a target generation signal to the voltage generator 55. Then, a charged target 27 may be pulled out through the nozzle unit 62, and passed through the through-hole in the pull-out electrode 66. The target 27 that has passed through the through-hole in the pull-out electrode 66 may be accelerated through an electric field between the pull-out electrode 66 and the aperture member 67, to which the reference potential is applied. Then, the target 27 may pass through the through-hole in the aperture member 67.

The deflection electrodes 70 may cause an electric field to act on the target 27 that has passed through the through-hole in the aperture member 67 to thereby deflect the direction of the target 27. When the target 27 needs to be deflected, the target control device 52 may output a control signal to the deflection electrode voltage generator 57 to control a potential difference between each pair of the deflection electrodes 70. The deflection electrode voltage generator 57 may be configured to apply a voltage between each pair of the deflection electrodes 70.

The target 27 may be deflected based on a control signal from the EUV light generation control device 51. Various signals may be transmitted between the EUV light generation control device 51 and the target control device 52. For example, the EUV light generation control device 51 may obtain information on the trajectory of the target 27 from a target sensor (not shown), and calculate a difference between the obtained trajectory and an ideal trajectory. Further, the EUV light generation control device 51 may be configured to send a signal to the target control device 52 to control a voltage applied between the deflection electrodes 70 so that the aforementioned difference becomes smaller. Here, the target 27 that has passed through the two pairs of the deflection electrodes 70 may pass through the through-hole 85*a* formed in the cover 85.

The cover 85 may shield electrically non-conductive members, such as the electrical insulator 65, from charged particles emitted from plasma generated in the plasma generation region 25. Gas in the space defined by the cover 85 and the lid 86 may be pumped out by the discharge device 71. As a result of this configuration, occurrence of a dielectric breakdown around the pull-out electrode 66, the aperture member 67, and the deflection electrodes 70 may be suppressed.

9. Target Supply Unit in Which Position-Adjustable Cover 9.1 Configuration

Figure 7:
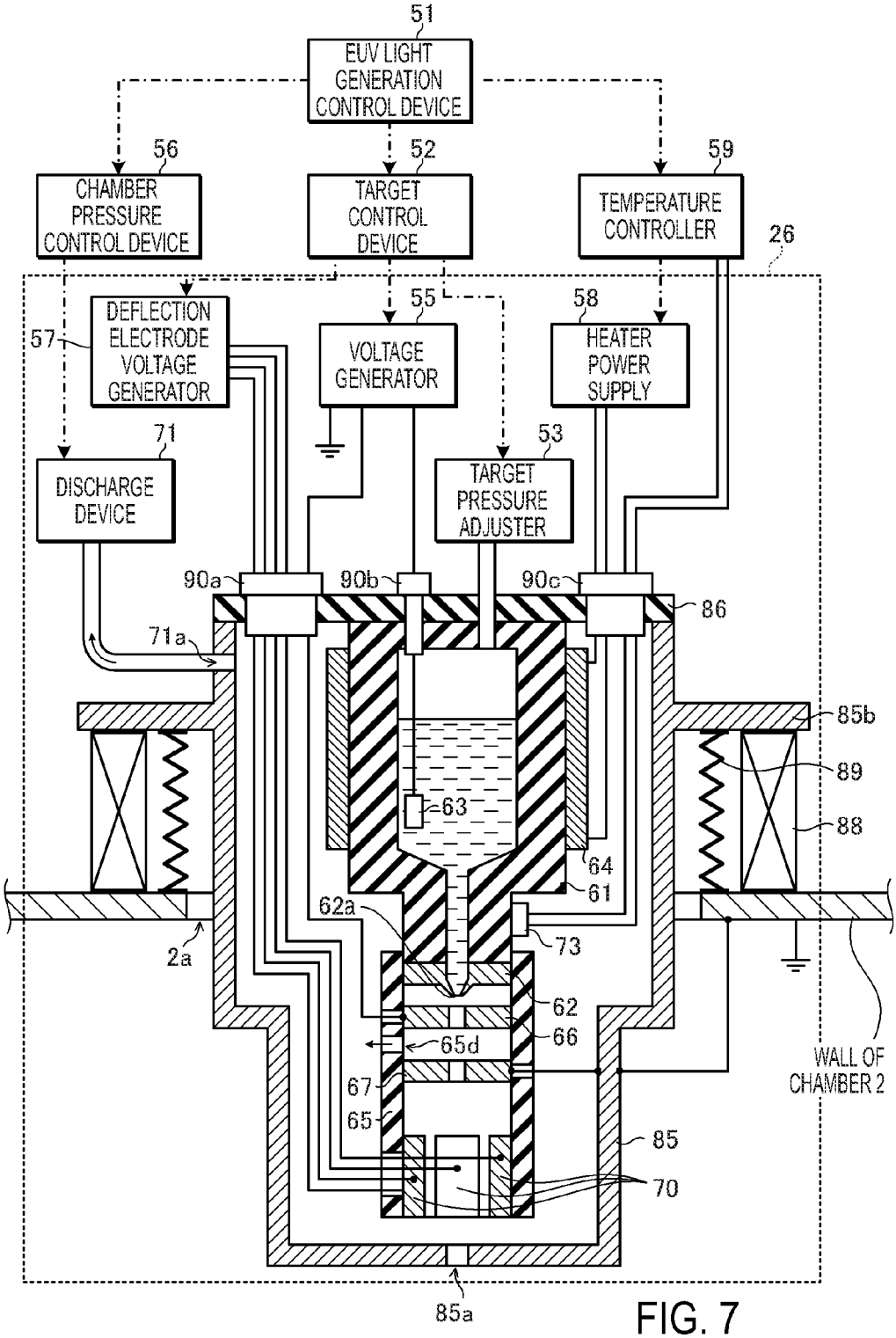
FIG. 7 is a sectional view illustrating a target supply unit according to a fifth embodiment and the peripheral components.

FIG. 7 is a sectional view illustrating a target supply unit according to a fifth embodiment and the peripheral components. In the fifth embodiment, the cover 85 may be mounted to the chamber 2 through an XY-moving stage 88.

As shown in FIG. 7, a through-hole 2*a* may be formed in the wall of the chamber 2. The cover 85 that houses the reservoir 61, the nozzle unit 62, and the electrical insulator 65 may pass through the through-hole 2*a*. A portion of the cover 85 where the through-hole 85*a* is formed may be located inside the chamber 2. The connection port 71*a* that is in communication with the discharge device 71 and the lid 86 may be located outside the chamber 2. A flange 85*b* may be provided on the cover 85 at a portion between a part where the through-hole 85*a* is formed and a part where the connection port 71*a* or the lid 86 is located.

The flange 85*b* may be connected to the wall of the chamber 2 through a flexible pipe 89 outside the chamber 2. More specifically, one end of the flexible pipe 89 may be fixed airtight to the wall of the chamber 2 around the through-hole 2*a*, and the other end of the flexible pipe 89 may be fixed airtight to the flange 85*b*. The flexible pipe 89 may be connected in the aforementioned manner between the wall of the chamber 2 and the flange 85*b* to seal the chamber 2 airtight. The flexible pipe 89 may be a bellows that may withstand the stress exerted by the difference in pressure inside and outside the chamber 2. In this way, the cover 85 and the wall of the chamber 2 may be connected so that the cover 85 may be movable relative to the chamber 2 while the chamber 2 is kept sealed airtight.

The XY-moving stage 88 may be connected between the wall of the chamber 2 and the flange 85*b* outside the flexible pipe 89. Although not shown in FIG. 7, an inert gas cylinder may be connected to the target pressure adjuster 53 through a pipe to supply an inert gas.

9.2 Operation and Effect

With the above configuration, the chamber 2 may be retained at low pressure, and the cover 85 may be held movably by the XY-moving stage 88. Further, gas in the space defined by the cover 85 and the lid 86 and outside the reservoir 61 may be pumped out by the discharge device 71. With this operation, occurrence of a dielectric breakdown around the pull-out electrode 66, the aperture member 67, and the deflection electrodes 70 may be suppressed.

The above-described embodiments and the modifications thereof are merely examples for implementing this disclosure, and this disclosure is not limited thereto. Making various modifications according to the specifications or the like is within the scope of this disclosure, and other various embodiments are possible within the scope of this disclosure. For example, the modifications illustrated for particular ones of the embodiments can be applied to other embodiments as well (including the other embodiments described herein).

The terms used in this specification and the appended claims should be interpreted as "non-limiting." For example, the terms "include" and "be included" should be interpreted as "including the stated elements but not limited to the stated elements." The term "have" should be interpreted as "having the stated elements but not limited to the stated elements." Further, the modifier "one (a/an)" should be interpreted as at least one or "one or more."

What is claimed is:

1. A target supply unit mounted to a chamber, comprising:

a nozzle unit having a through-hole to allow a target material to be outputted therethrough;

a cover provided to define a first space inside the cover and to cover the nozzle unit, the cover having a through-hole to allow the target material to pass therethrough from the first space to a second space inside the chamber; and a device configured to pump out gas inside the first space.

2. The target supply unit according to claim 1, further comprising:

an electrode provided to face the nozzle unit; and a voltage generator configured to apply a voltage between the target material and the electrode.

3. The target supply unit according to claim 1, wherein the cover is formed of an electrically conductive material.

4. The target supply unit according to claim 1, wherein the nozzle unit is disposed in the chamber, the cover is disposed in the changer to form together with the nozzle the first space which is a closed space inside the chamber.

5. A target supply unit mounted to a chamber, comprising:

a nozzle unit having a through-hole to allow a target material to be outputted therethrough;

a plurality of electrodes provided in a direction in which the target material travels;

an electrical insulator for holding the plurality of electrodes;

at least one voltage generator configured to apply a voltage between the plurality of electrodes;

a cover provided to define a first space inside the cover and to cover the nozzle unit, the plurality of electrodes, and the electrical insulator, the cover having a through-hole to allow the target material to pass therethrough from the first space to a second space inside the chamber; and a device configured to pump out gas in the first space.

6. The target supply unit according to claim 5, wherein the nozzle unit is disposed in the chamber, and the cover is disposed in the changer to form the first space in the chamber, the first space is a closed space containing the nozzle unit, the plurality of electrodes, and the electrical insulator.

7. An extreme ultraviolet light generation apparatus, comprising:

a chamber provided with a window through which a pulse laser beam travels into the chamber; and a target supply unit mounted to the chamber, the target supply unit comprising:

a nozzle unit having a through-hole to allow a target material to be outputted therethrough;

a cover provided to define a first space inside the cover and to cover the nozzle unit, the cover having a through-hole to allow the target material to pass therethrough from the first space to a second space inside the chamber; and a device configured to pump out gas inside the first space.

8. The extreme ultraviolet light generation apparatus according to claim 7, wherein the device is configured to pump out gas in the first space so that a gas pressure in the first space be lower than that in the second space.

9. The extreme ultraviolet light generation apparatus according to claim 7, wherein the nozzle unit is disposed in the chamber, the cover is disposed in the changer to form together with the nozzle the first space which is a closed space inside the chamber.

10. An extreme ultraviolet light generation apparatus, comprising:

a chamber provided with a window through which a pulse laser beam travels into the chamber; and a target supply unit mounted to the chamber, the target supply unit comprising:

a nozzle unit having a through-hole to allow a target material to be outputted therethrough;

a plurality of electrodes provided in a direction in which the target material travels;

an electrical insulator for holding the plurality of electrodes;

at least one voltage generator configured to apply a voltage between the plurality of electrodes;

a cover provided to define a first space inside the cover and to cover the nozzle unit, the plurality of electrodes, and the electrical insulator, the cover having a through-hole to allow the target material to pass therethrough from the first space to a second space inside the chamber; and a device configured to pump out gas in the first space.

11. The extreme ultraviolet light generation apparatus according to claim 10, wherein the device is configured to pump out gas in the first space so that a gas pressure in the first space be lower than that in the second space.

12. The extreme ultraviolet light generation apparatus according to claim 10, wherein the nozzle unit is disposed in the chamber, and the cover is disposed in the changer to form the first space in the chamber, the first space is a closed space containing the nozzle unit, the plurality of electrodes, and the electrical insulator.

* * * * *